US005822817A

United States Patent [19]

Carew et al.

[11] Patent Number: 5,822,817

[45] Date of Patent: Oct. 20, 1998

[54] INFANT MATTRESS SYSTEM WITH SLEEPING RECESS

[75] Inventors: James M. Carew; JoAnn Carew, both of Brattleboro, Vt.

[73] Assignee: Racing Strollers, Inc., Yakima, Wash.

[21] Appl. No.: 655,636

[22] Filed: May 30, 1996

Related U.S. Application Data

[63] Continuation-in-part of Ser. No. 336,007, Nov. 8, 1994.

[51] Int. Cl.[6] ..... A47C 27/05

[52] U.S. Cl. ..... 5/732; 5/424; 5/425; 5/655; 5/732

[58] Field of Search ..... 5/655, 900, 424, 5/425, 732

[56] References Cited

U.S. PATENT DOCUMENTS

| | | | |
|---|---|---|---|
| D. 288,636 | 3/1987 | McLaren | 5/425 |
| 1,473,370 | 11/1923 | Heller | 5/424 |
| 3,321,779 | 5/1967 | Kaufman et al. | 5/93 |
| 3,619,824 | 11/1971 | Doyle | 5/424 |
| 3,639,927 | 2/1972 | Munch | 5/91 |
| 3,742,528 | 7/1973 | Munch | 5/91 |
| 3,761,975 | 10/1973 | Personett | 5/348 |
| 4,081,868 | 4/1978 | Hull | 5/425 |
| 4,190,916 | 3/1980 | McMullan | 5/451 |
| 4,234,977 | 11/1980 | Snow | 5/655 |
| 4,286,344 | 9/1981 | Ikeda | 5/434 |
| 4,607,402 | 8/1986 | Pollard | 5/425 |
| 4,628,557 | 12/1986 | Murphy | 5/446 |
| 4,670,923 | 6/1987 | Gabriel et al. | 5/424 |
| 4,672,698 | 6/1987 | Sands | 5/424 |
| 4,754,509 | 7/1988 | Pollard | 5/425 |
| 4,788,726 | 12/1988 | Rafalko | 5/93 R |
| 4,872,228 | 10/1989 | Bishop | 5/425 |
| 4,873,734 | 10/1989 | Pollard | 5/425 |
| 4,934,002 | 6/1990 | Watanabe | 5/425 |
| 4,953,246 | 9/1990 | Matthews | 5/424 |
| 4,980,940 | 1/1991 | Isshiki | 5/425 |
| 4,999,863 | 3/1991 | Kane | 5/98.1 |
| 5,010,611 | 4/1991 | Mallett | 5/497 |
| 5,044,027 | 9/1991 | Moon | 5/448 |
| 5,103,514 | 4/1992 | Leach | 5/417 |
| 5,107,558 | 4/1992 | Luck | 5/464 |
| 5,261,133 | 11/1993 | Wilkerson | 5/655 |
| 5,343,575 | 9/1994 | Cartwright | 5/900 |
| 5,351,348 | 10/1994 | Berger | 5/420 |
| 5,359,740 | 11/1994 | Markley et al. | 5/425 |
| 5,455,973 | 10/1995 | Brumfield et al. | 5/424 |

FOREIGN PATENT DOCUMENTS

| | | | |
|---|---|---|---|
| 2211401 | 7/1989 | United Kingdom | 5/424 |

*Primary Examiner*—Rodney M. Lindsey
*Assistant Examiner*—Fredrick Conley
*Attorney, Agent, or Firm*—Seed and Berry LLP

[57] ABSTRACT

A mattress system for use in cribs or beds for small infants or adolescent children is constructed of a base and a sleeping recess defined by side walls, a head wall, a foot wall, and a floor. The mattress is constructed of a foam material which is air permeable. The mattress including the side, head, foot walls and floor of the recess, are enclosed in a removable cover. The floor of the recess is covered by a detachable vinyl panel formed as part of the cover and having hook or loop type strips. A second floor cover in the form of a detachable sheet, having mating hook or loop style patches which engage their opposite counterpart on the vinyl panel. An accessory panel is constructed having the dimensions of the recess to fill the recess and convert the specialty mattress into a conventional mattress.

7 Claims, 2 Drawing Sheets

INFANT MATTRESS SYSTEM WITH SLEEPING RECESS

This is a continuation-in-part of U.S. application for Ser. No. 08/336,007 filed Nov. 8, 1994.

BACKGROUND OF THE INVENTION

There are many accessories to cribs that are designed to limit the exposure of infants to hitting the hard sides of a crib while rolling and moving in their sleep or while playing or exploring in their crib.

A common accessory of this type is the bumpers which generally consist of bolsters tied to each side of the crib to cushion the hard surfaces from contact. Often these become loose or provide a step which can allow undesirable access for the infant to greater heights. Accessories of this type challenge the infants sense of curiosity and adventure which may result in creating more problems than they solve.

It is the purpose of this invention to provide a simple and convenient structure which will restrict the movement of the infant to an area away from the edges of the bed. It is also intended to package the mattress and its components as a system for facilitating replacement and cleaning of its surfaces.

The purpose of this invention is accomplished without the need for cumbersome accessories such as bumpers, bolsters and the like. With recent investigations into crib accidents and the bedtime activities of infants, bumpers and similar accessories have acquired a reputation for coming loose, providing foot holds, becoming displaced, being of limited effectiveness, and creating hazards. The recessed sleeping surface of the subject invention provides a means to restrict movement without building upward from the mattress surface.

SUMMARY OF THE INVENTION

A mattress system for use in cribs or beds for small infants or adolescent children is constructed of a base and a sleeping recess defined by side walls, a head wall, a foot wall, and a floor. The mattress is constructed of a foam material which is air permeable. The mattress including the side, head, foot walls and floor of the recess, are enclosed in a removable cover. The floor of the recess is covered by a detachable vinyl panel formed as part of the cover and having hook or loop type strips. A second floor cover in the form of a detachable sheet, having mating hook or loop style patches which engage their opposite counterpart on the vinyl panel. An accessory panel is constructed having the dimensions of the recess to fill the recess and convert the specialty mattress into a conventional mattress.

DESCRIPTION OF THE DRAWING

The invention is described in more detail below with reference to the attached drawing in which.

DESCRIPTION OF THE PREFERRED EMBODIMENT

Figure 1:
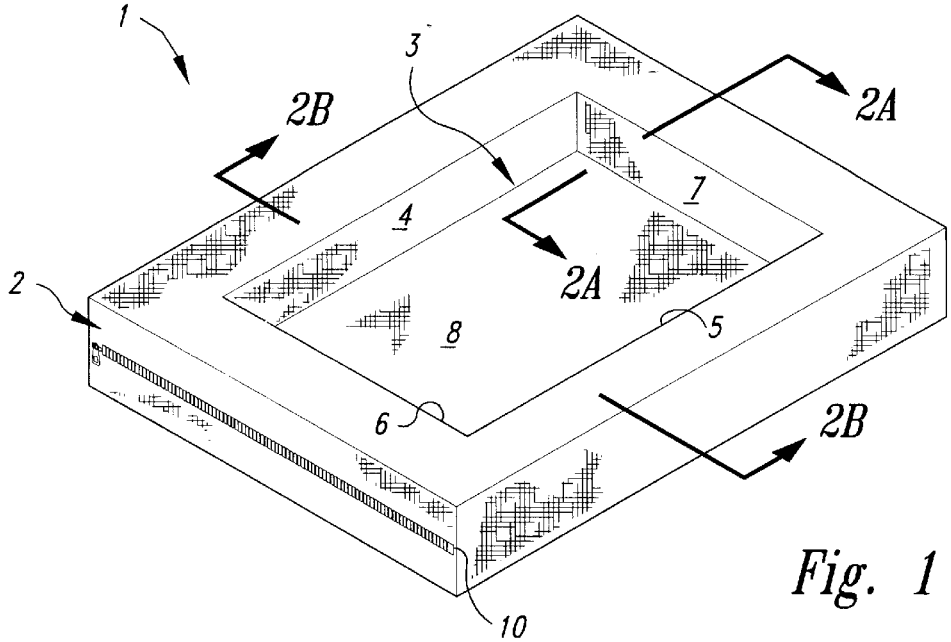
FIG. 1 is a perspective view of the assembled mattress system of this invention.

The mattress system 1 of this invention, as shown in FIG. 1, is constructed of a base 2 having constructed therein a recess 3. The recess 3 is defined by side walls 4 and 5, head wall 6, foot wall 7, and floor 8. The recess is constructed of a sufficient size to accommodate an infant in the prone position and to allow a comfortable amount of movement while restricting movement to a central portion of the crib (not shown). The overall dimensions of the base are generally about 28 inches wide by about 52 inches long. In such a size mattress, a centrally located recess of 20 inches wide by 44 inches long would provide a barrier of four inches surrounding the recess. It is desirable that the barrier be at least 4 inches from the sides of the crib.

The mattress is constructed of a foam material which provides a significant degree of air permeability, in a range to provide a maximum pressure drop of 20 mm of H2O at a test airflow of 25 scfm.

This is particularly important in the walls 4,5,6 and 7. The base 2 and recess 3 can be formed by molding a flat rectangular block and cutting out a central opening the size of the recess 3 to form a recess frame comprising walls 4,5,6, and 7. The frame is fixed by glue or other means to a second rectangular flat block which forms the floor 8 of the recess 3. The recess 3 is constructed from a foam block having a depth of from 3 to 5 inches. The block from which the floor 8 is formed should be at least 2 inches thick making the mattress 1 from 5 to 7 inches thick.

The mattress material also allows the absorption of any excess water which may enter the recess. In this manner water is not permitted to accumulate and the floor remains relatively dry. As shown in FIG. 2, an overall cover 9 is contoured to fit over the assembled base 2 and recess 3. A zippered opening 10 is constructed in the cover 9 to allow insertion and removal of the mattress base. For comfort and ease of maintenance the cover 9 is constructed of a soft polyester and cotton blend of 60 to 40 percent respectively.

Figure 2A:
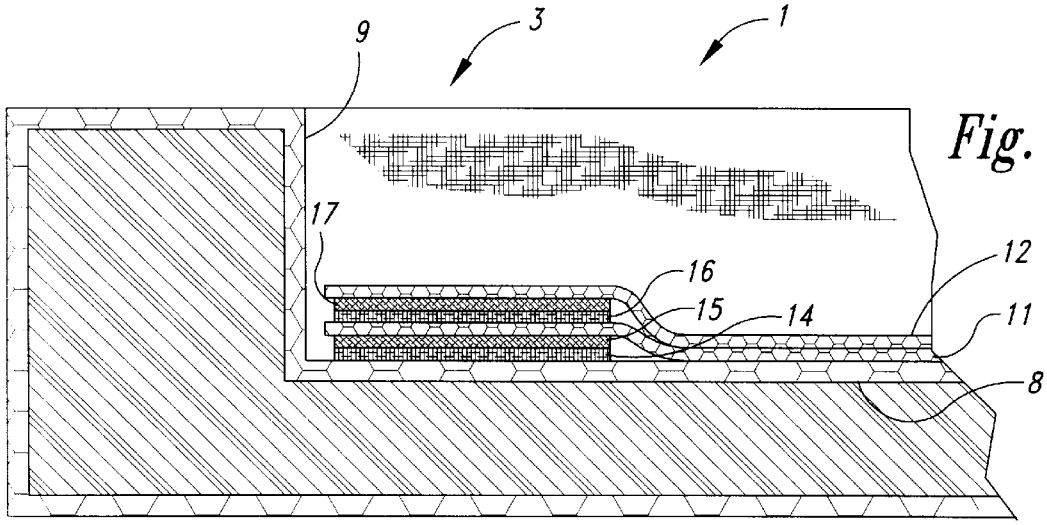
FIG. 2*a* is a sectional view taken along section lines 2*a*—2*a* showing the attachment components of the invention.
Figure 2B:
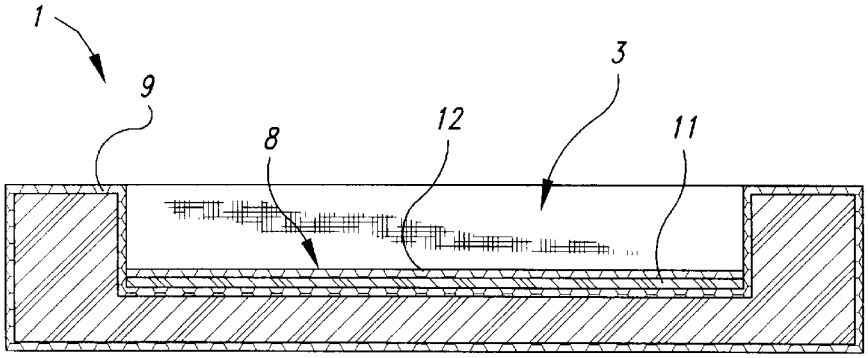
FIG. 2 is a sectional view taken along section lines 2–2 showing the components of the invention.

As best shown in FIG. 2*a*, the floor 8 of the recess includes strips 14 of hook or loop type fasteners at the head and foot secured to the foam panel that forms the floor 8. A vinyl water impervious floor panel 11 is constructed as part of the cover 8 having dimensions sufficient to cover the area of floor 8 and is provided with mating strips 15 of hook or loop type fasteners on its lower surface to removably secure the panel 11 with the cover 9 to floor 8. Further hook or loop type fastener strips 16 are attached to the upper surface of the panel 11. A matching sheet panel 12 is constructed of a polyester and cotton blend material and is provided with strips 17 of loop type fastener material at the foot and head of its lower surface to secure the panel 12 to the panel 11. The hook or loop type fastener material can be of the style sold under the trademark VELCRO. In situations like a hospital where VELCRO fasteners are not practical, the sheet panel 12 could be replaced by a semirigid pad fitted tot he floor. The pad would be covered by suitable sheeting material and its rigidity would hold it in place.

Figure 3:
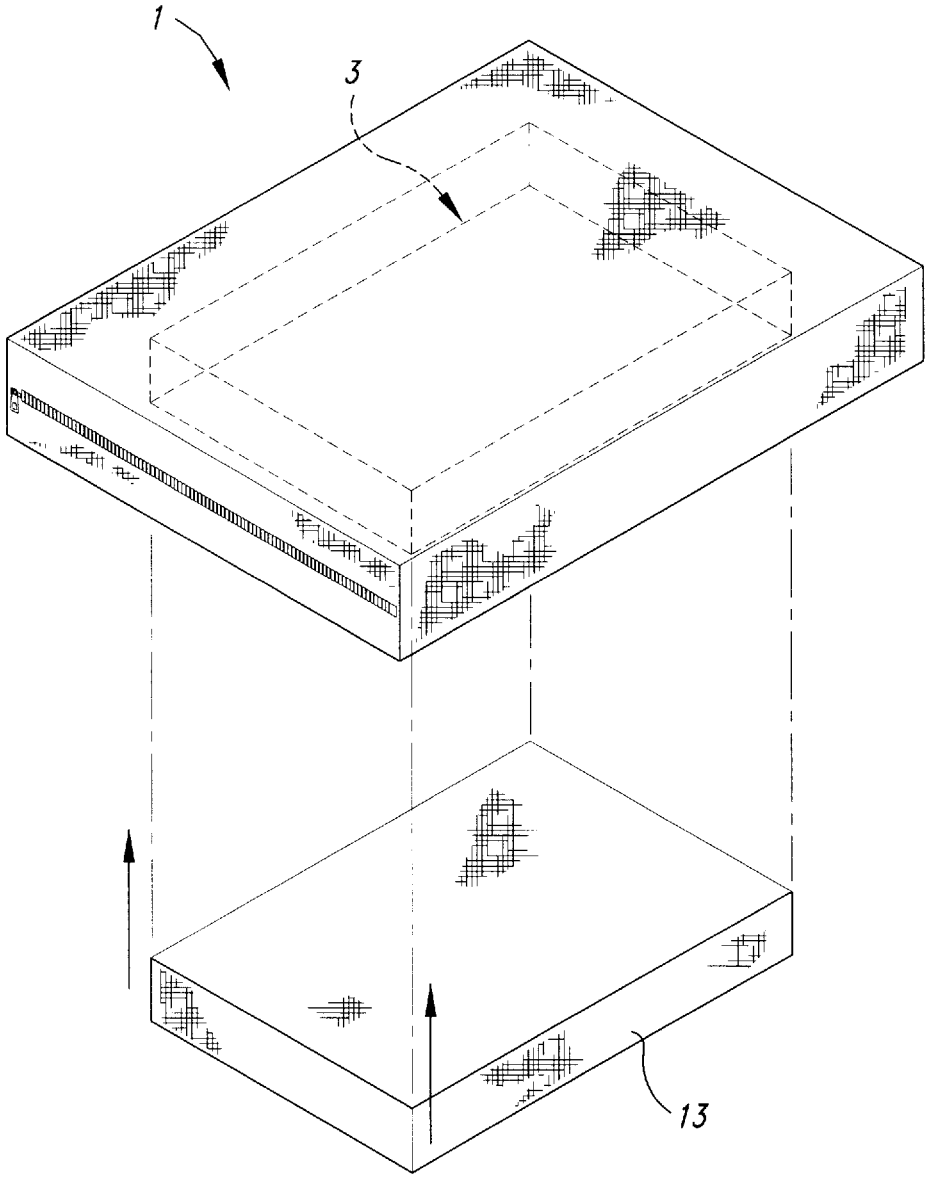
FIG. 3 is a perspective exploded view of the mattress of this invention showing the use of the insert panel.

Conveniently the material removed from the foam panel to form the frame of the recess 3, can be covered to form an accessory panel 13 to be inserted into the recess 3 to fill the space. By inverting the mattress and assembling the accessory panel the mattress system can be converted to a conventional mattress as shown in FIG. 3. The mattress can be converted when the child grows sufficiently to eliminate the need for the sleeping recess.

In this manner a complete mattress system is provided having a restrictive sleeping recess with air permeable walls and removable floor. The cover makes the system easy to use and contributes to the comfort of the user.

We claim:

1. A dual sleeping surface mattress, constructed to provide one sleeping surface which restricts the movement of an individual sleeping thereon, comprising:

a) a mattress body reversible between upward and downward facing orientations, with a pair of opposing, laterally spaced apart, outward side walls, and a pair of opposing, laterally spaced apart, outward end walls, said outward side walls and end walls defining a periphery of said mattress, said mattress body having:

a) first horizontal body surface facing upward when said mattress body is in said upward facing orientation and extending about said periphery of said mattress body along said outward side walls and end walls of said mattress body;

a second horizontal body surface opposite said first horizontal body surface and facing downward when said mattress body is in said upward facing orientation and upward when said mattress body is in said downward facing orientation, said second horizontal body surface extending substantially fully between said outward side walls and end walls of said mattress body;

a pair of opposing, laterally spaced apart, inward side walls extending downward into said mattress body from said first horizontal body surface when said mattress body is in said upward facing orientation, said inward side walls positioned inward from and substantially parallel to said outward side walls to form a pair of spaced apart peripheral barriers extending substantially the full length of said mattress body, said inward side walls being a pliant and soft air permeable plastic foam material to cushion the sleeping individual;

a pair of opposing, laterally spaced apart, inward end walls, extending downward into said mattress body from said first horizontal body surface when said mattress body is in said upward facing orientation, and transverse to said inward side walls, said inward end walls positioned inward from and substantially parallel to said outward end walls to form a pair of spaced apart peripheral barriers extending substantially the full width of said mattress body, said inward end walls being a pliant and soft air permeable plastic foam material to cushion the sleeping individual; and an exposed flat first sleeping surface for receiving the sleeping individual thereon, recessed from said first horizontal body surface when said mattress body is in said upward facing orientation and defined by said inward side walls and said inward end walls, with said inward side walls, said inward end walls, and said recessed first sleeping surface defining an upwardly open recess in said mattress body when said mattress body is in said upward facing orientation, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body, said pairs of peripheral barriers and said recessed first sleeping surface having a unitary construction without sufficiently sized opening therebetween to prevent the sleeping individual on said recessed first sleeping surface from extending an arm, leg or head between said barriers and said recessed first sleeping surface, and said recessed first sleeping surface further comprising:

attachment means secured to said recessed first sleeping surface for receiving mating attachment means;

a cover contoured to enclose said entire mattress body and removably secured thereto;

a water impervious panel constructed in said cover in alignment with said recessed first sleeping surface, having mating attachment means on a lower surface thereof for detachable engagement with said recessed first sleeping surface attachment means, said mating attachment means securing said water impervious panel and cover to said recessed first sleeping surface during use and allowing removal thereof for cleaning;

second attachment means secured to an upper surface of said water impervious panel for receiving second mating attachment means; and a second panel constructed of sheeting material having mating second attachment means on a lower surface thereof for detachable engagement with said second attachment means, said mating second attachment means securing said second panel to said water impervious panel during use and allowing removal thereof for cleaning;

b) a mattress inset removably positionable within said recess and sized to substantially fill said recess when positioned within said recess, said inset having:

a first horizontal inset surface sized to extend substantially fully between said inward side walls and end walls when said inset is positioned within said recess; and a second horizontal inset surface sized to be positionable adjacent to said recessed first sleeping surface when in position within said recess, said first and second horizontal inset surfaces being spaced apart by a distance such that when said inset is positioned within said recess said first horizontal inset surface is substantially coplanar and contiguous with said first horizontal body surface to define together a flat surface extending substantially to said periphery of said mattress body, with said combined flat surface when said mattress body is in said upward facing orientation and said second horizontal body surface when said mattress body is in said downward facing orientation defining an exposed flat second sleeping surface larger than said recessed first sleeping surface for receiving the sleeping individual thereon when said inset is positioned within said recess.

2. The mattress of claim 1, wherein said mattress body is constructed of two elements comprising:

a. a base element formed of air permeable plastic foam; and b. a frame element formed of air permeable plastic foam, having a central opening in the shape of said recess to define said inward side walls and end walls, said frame element fixed to said base element to form a floor of said recess.

3. The mattress of claim 1, wherein said water impervious panel is constructed of vinyl.

4. The mattress of claim 1, wherein said inward side and end walls are integrally constructed in said mattress body.

5. The mattress of claim 1, wherein said inward side and end walls and said recessed first sleeping surface are constructed of the same material.

6. A dual sleeping surface mattress, constructed to provide one sleeping surface which restricts the movement of an individual sleeping thereon, comprising:

a) a mattress body reversible between upward and downward facing orientations, with a pair of opposing, laterally spaced apart, outward side walls, and a pair of opposing, laterally spaced apart, outward end walls, said outward side walls and end walls defining a periphery of said mattress, said mattress body having:

a first horizontal body surface facing upward when said mattress body is in said upward facing orientation and extending about said periphery of said mattress body along said outward side walls and end walls of said mattress body;

a second horizontal body surface opposite said first horizontal body surface and facing downward when said mattress body is in said upward facing orientation and upward when said mattress body is in said downward facing orientation, said second horizontal body surface extending substantially fully between said outward side walls and end walls of said mattress body;

a pair of opposing, laterally spaced apart, inward side walls extending downward into said mattress body from said first horizontal body surface when said mattress body is in said upward facing orientation, said inward side walls positioned inward from and substantially parallel to said outward side walls to form a peripheral barrier extending substantially the full length of said mattress body, said inward end walls being constructed of air permeable plastic foam;

a pair of opposing, laterally spaced apart, inward end walls, extending downward into said mattress body from said first horizontal body surface when said mattress body is in said upward facing orientation, and transverse to said inward side walls, said inward end walls positioned inward from and substantially parallel to said outward end walls to form a peripheral barrier extending substantially the full width of said mattress body, said inward end walls being constructed of air permeable plastic foam; and an exposed first sleeping surface for receiving the sleeping individual thereon, recessed from said first horizontal body surface when said mattress body is in said upward facing orientation and defined by said inward side walls and said inward end walls, with said inward side walls, said inward end walls, and said recessed first sleeping surface defining an upwardly open recess in said mattress body when said mattress body is in said upward facing orientation, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body, and said recessed first sleeping surface further comprising:

attachment means secured to said recessed first sleeping surface for receiving mating attachment means;

a cover contoured to enclose said entire mattress body and removably secured thereto;

a water impervious panel constructed in said cover in alignment with said recessed first sleeping surface, having mating attachment means on a lower surface thereof for detachable engagement with said recessed first sleeping surface attachment means, said mating attachment means securing said water impervious panel and cover to said recessed first sleeping surface during use and allowing removal thereof for cleaning;

second attachment means secured to an upper surface of said water impervious panel for receiving second mating attachment means, and a second panel constructed of sheeting material having mating second attachment means on a lower surface thereof for detachable engagement with said second attachment means, said mating second attachment means securing said second panel to said water impervious panel during use and allowing removal thereof for cleaning;

b) a mattress inset removably positionable within said recess and sized to substantially fill said recess when positioned within said recess, said inset having:

a first horizontal inset surface; and a second horizontal inset surface sized to be positionable adjacent to said recessed first sleeping surface when in position within said recess, said first and second horizontal inset surfaces being spaced apart by a distance such that when said inset is positioned within said recess said first horizontal inset surface is substantially coplanar with said first horizontal body surface to define together a flat surface extending substantially to said periphery of said mattress body, with said second horizontal body surface when said mattress body is in said downward facing orientation defining an exposed second sleeping surface larger than said recessed first sleeping surface for receiving the sleeping individual thereon when said inset is positioned within said recess.

7. A dual sleeping surface mattress, constructed to provide one sleeping surface which restricts the movement of an individual sleeping thereon, comprising:

a) a mattress body positionable in upward and downward facing orientations, with a pair of opposing, laterally spaced apart, outward side walls, and a pair of opposing, laterally spaced apart, outward end walls, said outward side walls and end walls defining a periphery of said mattress, said mattress body having:

a first horizontal body surface facing upward when said mattress body is in said upward facing orientation and extending about said periphery of said mattress body along said outward side walls and end walls of said mattress body;

a second horizontal body surface opposite said first horizontal body surface and facing downward when said mattress body is in said upward facing orientation and upward when said mattress body is in said downward facing orientation, said second horizontal body surface extending substantially fully between said outward side walls and end walls of said mattress body;

a pair of opposing, laterally spaced apart, inward side walls extending downward into said mattress body from said first horizontal body surface when said mattress body is in said upward facing orientation, said inward side walls positioned inward from said outward side walls to form a peripheral barrier extending substantially the full length of said mattress body, said inward end walls being constructed of air permeable plastic foam;

a pair of opposing, laterally spaced apart, inward end walls, extending downward into said mattress body from said first horizontal body surface when said mattress body is in said upward facing orientation, and transverse to said inward side walls, said inward end walls positioned inward from said outward end walls to form a peripheral barrier extending substantially the full width of said mattress body, said inward end walls being constructed of air permeable plastic foam; and an exposed first sleeping surface for receiving the sleeping individual thereon, recessed from said first horizontal body surface when said mattress body is in said upward facing orientation and defined by said inward side walls and said inward end walls, with said inward side walls, said inward end walls, and said recessed first sleeping surface defining an upwardly open recess in said mattress body when said mattress body is in said upward facing orientation, said recessed first sleeping surface being of sufficient surface area to accommodate the full body of the sleeping individual thereon and said inward side walls and said inward end walls being of sufficient height to restrict movement of the sleeping individual on said recessed first sleeping surface beyond said periphery of said mattress body, and said recessed first sleeping surface further comprising:

attachment means secured to said recessed first sleeping surface for receiving mating attachment means;

a cover contoured to enclose said entire mattress body and removably secured thereto;

a water impervious panel constructed in said cover in alignment with said recessed first sleeping surface, having mating attachment means on a lower surface thereof for detachable engagement with said recessed first sleeping surface attachment means, said mating attachment means securing said water impervious panel and cover to said recessed first sleeping surface during use and allowing removal thereof for cleaning;

second attachment means secured to an upper surface of said water impervious panel for receiving second mating attachment means; and a second panel constructed of sheeting material having mating second attachment means on a lower surface thereof for detachable engagement with said second attachment means, said mating second attachment means securing said second panel to said water impervious panel during use and allowing removal thereof for cleaning;

b) a mattress inset removably positionable within said recess and sized to substantially fill said recess when positioned within said recess, said inset having:

a first horizontal inset surface; and a second horizontal inset surface sized to be positionable adjacent to said recessed first sleeping surface when in position within said recess, said first and second horizontal inset surfaces being spaced apart by a distance such that when said inset is positioned within said recess said first horizontal inset surface is substantially coplanar with said first horizontal body surface to define together a flat surface extending substantially to said periphery of said mattress body, with at least one of said combined flat surface when said mattress body is in said upward facing orientation or said second horizontal body surface when said mattress body is in said downward facing orientation defining an exposed second sleeping surface larger than said recessed first sleeping surface for receiving the sleeping individual thereon when said inset is positioned within said recess.

* * * * *